US011022063B2

(12) United States Patent
Bischofberger et al.

(10) Patent No.: US 11,022,063 B2
(45) Date of Patent: Jun. 1, 2021

(54) CYLINDER BORE FOR A CYLINDER HOUSING OF AN INTERNAL COMBUSTION ENGINE, AND ARRANGEMENT HAVING A CYLINDER BORE AND A PISTON

(71) Applicant: Mahle International GmbH, Stuttgart (DE)

(72) Inventors: Ulrich Bischofberger, Esslingen (DE); Stefan Gaiselmann, Stuttgart (DE)

(73) Assignee: Mahle International GmbH

( * ) Notice: Subject to any disclaimer, the term of this patent is extended or adjusted under 35 U.S.C. 154(b) by 9 days.

(21) Appl. No.: 15/576,274

(22) PCT Filed: May 20, 2016

(86) PCT No.: PCT/EP2016/061468

§ 371 (c)(1),
(2) Date: Nov. 21, 2017

(87) PCT Pub. No.: WO2016/188916

PCT Pub. Date: Dec. 1, 2016

(65) Prior Publication Data

US 2018/0149109 A1 May 31, 2018

(30) Foreign Application Priority Data

May 22, 2015 (DE) ..... 10 2015 006 498.3

(51) Int. Cl.
*F02F 1/20* (2006.01)
*F02F 1/00* (2006.01)
(Continued)

(52) U.S. Cl.
CPC ..... *F02F 1/20* (2013.01); *F02F 1/004* (2013.01); *F02F 1/18* (2013.01); *F02F 3/0084* (2013.01)

(58) Field of Classification Search
CPC ..... F02F 1/20; F02F 1/004; F02F 1/18
(Continued)

(56) References Cited

U.S. PATENT DOCUMENTS 5,630,953 A 5/1997 Klink
2003/0021711 A1* 1/2003 Klink ..... B23H 9/008 417/572

(Continued)

FOREIGN PATENT DOCUMENTS

CN 201991633 U 9/2011
DE 3029215 A1 3/1982

(Continued)

OTHER PUBLICATIONS

English abstract for DE-3029215.

(Continued)

*Primary Examiner* — Lindsay M Low
*Assistant Examiner* — Omar Morales
(74) *Attorney, Agent, or Firm* — Fishman Stewart PLLC

(57) ABSTRACT

A cylinder bore for a cylinder housing of an internal combustion engine may have a cylinder running surface, an upper reversal point and a lower reversal point at which a piston, which may be moved up and down in the cylinder bore and may have piston rings and a piston skirt, may reach a speed which approaches zero during engine operation. The cylinder bore may also have a region between the upper reversal point and the lower reversal point at which the piston may reach a maximum speed during engine operation. The cylinder bore may further have at least two circumferential depressions formed within the region, the at least two circumferential depressions each having a diameter that may be greater than a diameter of the cylinder bore above the region and below the region.

19 Claims, 2 Drawing Sheets

(51) Int. Cl.
*F02F 1/18* (2006.01)
*F02F 3/00* (2006.01)

(58) Field of Classification Search
USPC ..... 123/193.4
See application file for complete search history.

(56) References Cited

U.S. PATENT DOCUMENTS

| | | | | |
|---|---|---|---|---|
| 2004/0226402 | A1 | 11/2004 | Fuchs et al. | |
| 2012/0227699 | A1 * | 9/2012 | Perry | F02F 1/20 123/193.4 |

FOREIGN PATENT DOCUMENTS

| | | | | |
|---|---|---|---|---|
| DE | 4316012 | A1 | 11/1994 | |
| DE | 19614328 | A1 | 10/1997 | |
| DE | 10355685 | A1 | 7/2005 | |
| DE | 10360148 | A1 | 7/2005 | |
| DE | 102006057111 | A1 | 6/2008 | |
| DE | 102008026146 | A1 | 12/2009 | |
| DE | 102012201342 | A1 | 8/2013 | |
| DE | 102014017361 | A1 | 6/2016 | |
| EP | 0943794 | A1 | 9/1999 | |
| JP | 2013113275 | A | 6/2013 | |
| KR | 20130070397 | A | 6/2013 | |
| WO | WO-98/53192 | A1 | 11/1998 | |
| WO | WO-00/40850 | A1 | 7/2000 | |
| WO | WO-0040850 | A1 * | 7/2000 | F02F 1/20 |

OTHER PUBLICATIONS

English abstract for DE-19614328.
English abstract for DE-102006057111.
English abstract for EP-0943794.
English abstract for CN-201991633.
English abstract for DE-102008026146.
English abstract for DE-102014017361.
English abstract for JP-2013113275.
English abstract for DE-10355685.
English abstract for KR-20130070397.
English abstract for DE-DE102012201342.
English abstract for DE-10360148.

* cited by examiner

CYLINDER BORE FOR A CYLINDER HOUSING OF AN INTERNAL COMBUSTION ENGINE, AND ARRANGEMENT HAVING A CYLINDER BORE AND A PISTON

CROSS-REFERENCE TO RELATED APPLICATIONS

This application claims priority to International Patent Application No. PCT/EP2016/061468, filed on May 20, 2016, and German Patent Application No. 10 2015 006 498.3, filed on May 22, 2015, the contents of both which are incorporated herein by reference in their entireties.

TECHNICAL FIELD

The present invention relates to a cylinder bore with a cylinder running surface for a cylinder housing of an internal combustion engine, wherein an upper reversal point and a lower reversal point are defined in the cylinder bore, a piston, which is moved up and down in the cylinder bore, reaching a speed which approaches zero at said points during engine operation, and wherein the piston reaches a maximum speed in a region between the upper reversal point and the lower reversal point.

BACKGROUND

A cylinder bore of the type in question is disclosed for example in DE 10 2012 201 342 A1. The cylinder running surface of such a cylinder bore has locally different roughness structures at different height regions.

DE 103 60 148 A1 discloses a cylinder bore with a cylinder running surface in which microstructures are incorporated at the top and bottom dead center region.

As a rule, cylinder running surfaces should have a defined roughness in order to optimize the lubrication between the cylinder running surface and the piston rings of the piston which is guided in the cylinder bore, since lubricating oil is received in the depressions of such cylinder running surfaces. However, for modern internal combustion engines, it is required to reduce the roughness of the cylinder running surfaces in order to minimize the friction in this manner. However, the lubrication between the cylinder running surface and the piston rings is adversely affected by this measure. It should be additionally pointed out that the piston skirt should bear as tightly as possible against the cylinder running surface in order to ensure optimum guidance of the piston in the cylinder. On the other hand, it is known that the friction can be reduced by increasing the play between the piston skirt and the cylinder running surface. Owing to the increased secondary movement of the piston induced thereby and the noise generation caused as a result, such a measure can be implemented in practice only to a limited extent.

In this regard, it is proposed in DE 10 2008 026 146 A1 that, in the region between the upper and the lower reversal point, the cylinder diameter is designed to be greater than at the reversal points themselves. The basis for this is the idea that the piston has to be guided tightly only in the region of the upper and lower reversal point in order to effectively avoid noise generation. However, it has been shown that, in particular in the case of multicylinder engines or engines which are additionally influenced by external forces during operation, a piston which is freely movable in the region between the upper and lower reversal point is exposed to considerable transverse accelerations and thus is nevertheless inclined to noise generation.

The object of the present invention thus consists in developing a cylinder bore of the type in question for an internal combustion engine in such a way that the friction losses between the cylinder running surface and piston skirt are reduced as far as possible without adversely affecting the guidance of the piston in the cylinder during engine operation and causing undesired noise generation. Furthermore, the lubrication between the cylinder running surface and the piston skirt or the piston rings should remain ensured.

The solution consists in at least two circumferential depressions being formed within the region, the diameter of which depressions is greater than the diameter of the cylinder bore above the region and is greater than the diameter below the region.

SUMMARY

The present invention further relates to an arrangement consisting of a cylinder bore according to the invention and a piston.

According to the invention, the term "cylinder bore" is understood to mean both a cylinder liner received in an engine block and a bore incorporated directly into the engine block. In the following, "cylinder running surface" is understood in both cases to mean the surface of the cylinder liner or of the bore incorporated directly into the engine block.

The solution according to the invention is distinguished by the fact that, at least in a part of that region of the cylinder bore in which the piston, in the region of its piston skirt, guided up and down therein reaches its maximum speed during engine operation, the cylinder bore according to the invention has at least two depressions with a greater diameter than above and below this region. According to the invention, the friction is minimized in this region since the lubricating film thickness is increased. As a result, the hydrodynamic friction component between the piston skirt and the cylinder running surface is reduced. Furthermore, the friction behavior between the piston rings and cylinder running surface is improved.

According to the invention, the piston skirt is guided at least partially in the cylinder since running surface regions which are in tight sliding contact with the piston skirt are present between the depressions. At the same time, the play between the piston skirt and cylinder running surface in the region of high piston speed is increased by the depressions provided according to the invention. An effective reduction in the friction between the piston skirt and cylinder running surface is thus achieved. At the same time, a situation is avoided in which the piston is deflected by the occurrence of transverse accelerations emanating from the neighboring cylinders or the movement of a vehicle in such a way that the piston skirt strikes against the cylinder running surface and thus causes undesired noise generation.

Advantageous developments will emerge from the subclaims.

The diameters of the circumferential depressions provided according to the invention are preferably identical, i.e. they have the same dimensions. This measure simplifies the production of the cylinder bore according to the invention. The diameters in the region of the upper and lower reversal point of the cylinder bore are also preferably identical, i.e. they have the same dimensions. Furthermore, it is preferable that the diameters in the region of the upper and lower reversal point of the cylinder bore are constant in order to ensure optimal guiding of the piston skirt in the cylinder bore.

The diameter of the cylinder bore in at least a part of the region between the upper reversal point and the lower reversal point is preferably greater by 5 μm to 30 μm than the diameter of the cylinder bore above and/or below this region. In a surprising manner to a person skilled in the art, this value has emerged in engine operation as an optimum compromise between as far as possible reduced friction and still reliably functioning piston guidance.

The transitions between the depressions according to the invention and the above or below partial surfaces of the cylinder running surface outside the depression are preferably designed to be rounded. This has the advantage that, in the cylinder bore designed according to the invention, the piston or the piston rings constantly pass the depression provided according to the invention in a sliding manner.

The roughness $R_z$ of the cylinder running surface in the region of the depression is preferably less than in the regions outside the depression. In a surprising manner for a person skilled in the art, it has been shown that a reduction in the roughness in the region of the depression provided according to the invention additionally leads to a significant reduction in the friction between the cylinder running surface and the piston or the piston rings.

The roughness $R_z$ in the region of the depression provided according to the invention is preferably less than 3 μm, particularly preferably less than 1 μm, in particular less than 0.5 μm.

In a preferred development, the cylinder running surface has, at least in the region of its partial surfaces outside the depression provided according to the invention, a greater hardness (measured according to Vickers or Brinell) than in the region of the depression. This can be achieved for example by means of an induction hardening process known per se. Of course, the entire cylinder running surface can also have a greater hardness than the material of the cylinder bore in the region with which the piston has no contact, for example the material of a cylinder liner.

The arrangement according to the invention consisting of a cylinder bore and a piston can for example comprise a piston whose piston skirt consists of a steel material and/or in which at least one piston ring is provided, at least in the contact region with the cylinder running surface, with a CrN coating or DLC coating produced by means of a PVD process. These measures further reduce the friction between the piston skirt or the piston rings and the cylinder running surface. It has moreover been shown that this coating additionally reduces the running surface wear both of the piston rings and of the cylinder bore.

The present invention is particularly suitable for internal combustion engines for motor vehicles having at least two cylinders.

BRIEF DESCRIPTION OF THE DRAWINGS

Exemplary embodiments of the present invention will be described in more detail below with reference to the appended drawings. In a schematic illustration which is not true to scale.

DETAILED DESCRIPTION

Figures 1A, 1B:
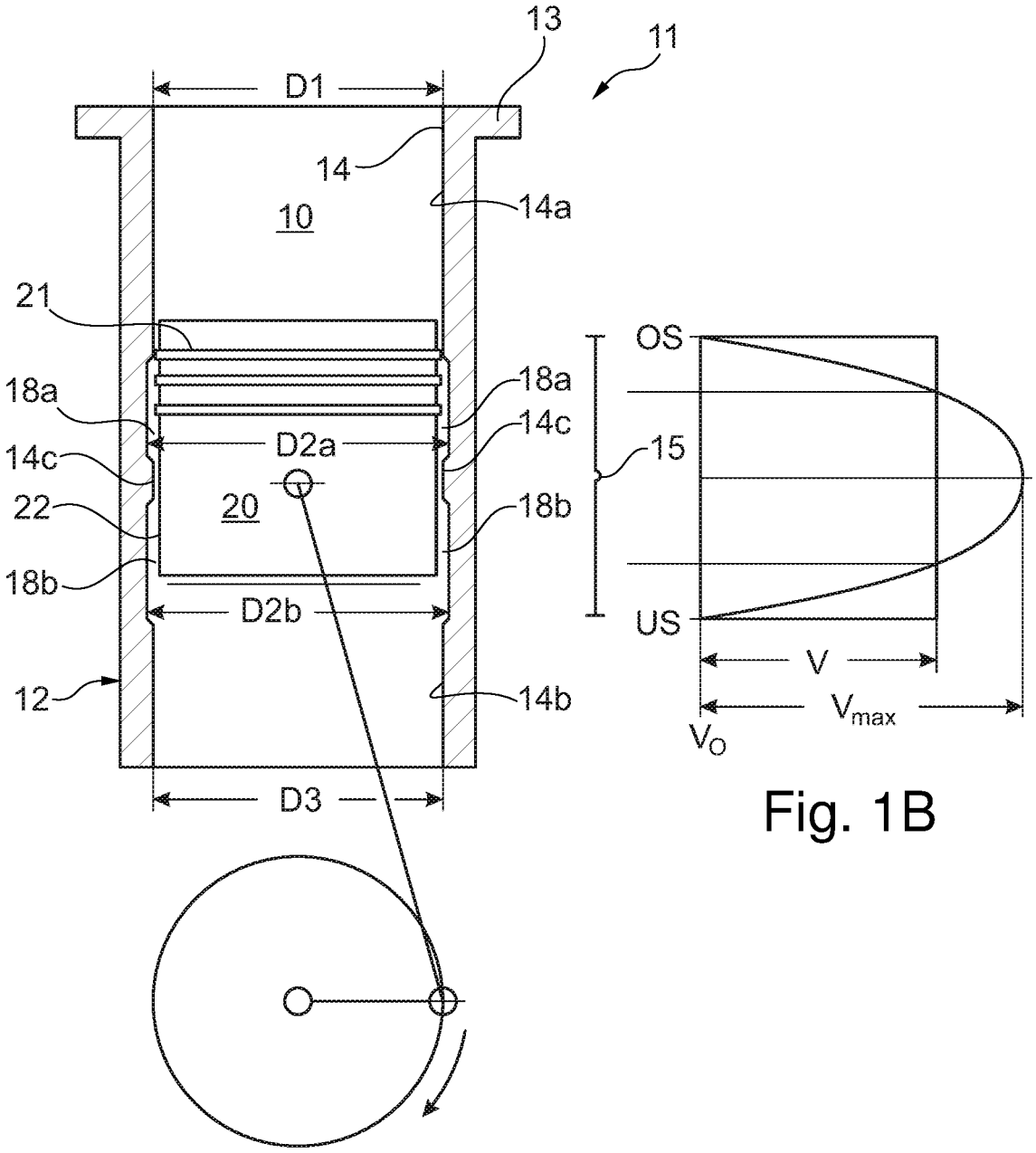
FIG. 1A shows a first exemplary embodiment of a cylinder bore according to the invention in the form of a cylinder liner having a piston, which is guided up and down therein.
FIG. 1B shows a speed profile of the piston skirt correlated thereto during engine operation.

The cylinder bore 10 according to the invention illustrated in FIG. 1A is configured in the form of a cylinder liner 11. The cylinder liner 11 can consist for example of a cast iron material, in the exemplary embodiment of a cast iron material with lamellar graphite, and can be produced for example by a centrifugal casting process. In the exemplary embodiment, the cylinder liner 11 has a shaft 12 with a circumferential flange 13, and a cylinder running surface 14.

A piston 20, which has piston rings 21 and a piston skirt 22, is guided upward and downward in the cylinder liner 11 during engine operation. During engine operation, the piston skirt 22 moves along the cylinder running surface 14 between an upper reversal point OS and a lower reversal point US, where the piston 20 reaches a speed $v_o$ which approaches zero. The point of minimum speed is defined on the piston 20 itself at the highest loaded point of the piston skirt 22. During engine operation, the piston skirt 22 reaches a higher speed v, with a maximum speed $v_{max}$, within a region 15 between the upper reversal point OS and the lower reversal point US.

In this region 15, there is provision according to the invention that two circumferential depressions 18*a*, 18*b* are provided which have a diameter D2*a*, D2*b* which are greater than the diameter D1 above the region 15 and the diameter D3 below the region 15. The difference between the diameters D2*a*, D2*b* and the diameters D1 and D3 is preferably 5 μm to 30 μm.

Above and below the region 15 there are formed running surface regions 14*a*, 14*b* of the cylinder running surface 14 which are in frictional contact with the piston rings 21 during engine operation.

It can also be seen from FIG. 1A that the diameters D2*a*, D2*b* have identical dimensions. The diameters D1 and D3 likewise have identical dimensions. The diameters D1 and D3 are furthermore constant over their heights h1 and h3.

Between the depressions 18*a*, 18*b* there is situated a further circumferential running surface region 14*c* which is in frictional contact with the piston rings 21 during engine operation. This means that the piston 20 is guided securely along the running surface regions 14*a*, 14*b*, 14*c* during engine operation, with the result that a deflection of the piston skirt 22 due to possibly occurring transverse accelerations is avoided.

Figures 2A, 2B:
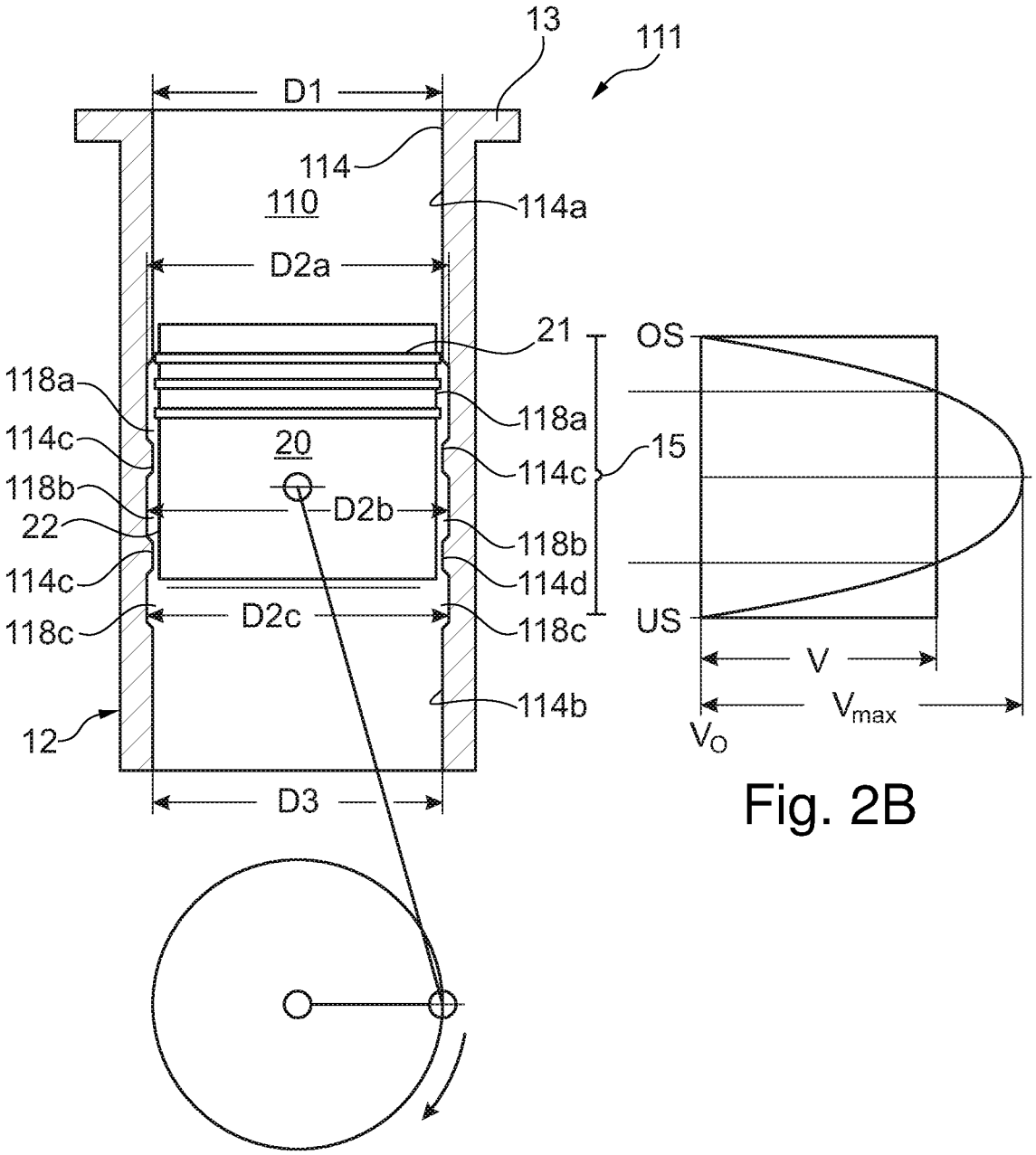
FIG. 2A shows a further exemplary embodiment of a cylinder bore according to the invention in the form of a cylinder liner having a piston, which is guided up and down therein.
FIG. 2B shows a speed profile of the piston skirt that is correlated thereto during engine operation.

The cylinder bore 110 according to the invention illustrated in FIG. 2A is likewise configured in the form of a cylinder liner 111. The cylinder liner 111 can consist for example of a cast iron material, in the exemplary embodiment of a cast iron material with lamellar graphite, and can be produced for example by a centrifugal casting process. In the exemplary embodiment, the cylinder liner 111 has a shaft 112 with a circumferential flange 113, and a cylinder running surface 114.

A piston 20, which has piston rings 21 and a piston skirt 22, is guided upward and downward in the cylinder liner 111 during engine operation. During engine operation, the piston skirt 22 moves along the cylinder running surface 114 between an upper reversal point OS and a lower reversal point US, where the piston 20 reaches a speed $v_o$ which approaches zero. The point of minimum speed is defined on the piston 20 itself at the highest loaded point of the piston skirt 22. During engine operation, the piston skirt 22 reaches a higher speed v, with a maximum speed $v_{max}$, within a region 115 between the upper reversal point OS and the lower reversal point US.

In this region 115, there is provision according to the invention that three circumferential depressions 118*a*, 118*b*, 118*c* are provided which have a diameter D2*a*, D2*b* and D2*c* which are greater than the diameter D1 above the region 115 and the diameter D3 below the region 115. The difference between the diameters D2*a*, D2*b*, D2*c* and the diameters D1 and D3 is preferably 5 μm to 30 μm.

Above and below the region 115 there are formed running surface regions 114*a*, 114*b* of the cylinder running surface 114 which are in frictional contact with the piston rings 21 during engine operation.

It can also be seen from FIG. 1A that the diameters D2*a*, D2*b*, D2*c* have identical dimensions. The diameters D1 and D3 likewise have identical dimensions. The diameters D1 and D3 are furthermore constant over their heights h1 and h3.

Between the depressions 118*a*, 118*b*, 118*c* there are situated two further circumferential running surface regions 114*c*, 114*d* which are in frictional contact with the piston rings 21 during engine operation. This means that the piston 20 is guided securely along the running surface regions 114*a*, 114*b*, 114*c*, 114*d* during engine operation, with the result that a deflection of the piston skirt 22 due to possibly occurring transverse accelerations is avoided.

The invention claimed is:

1. A cylinder bore for a cylinder housing of an internal combustion engine, comprising:

a cylinder running surface;

an upper reversal point and a lower reversal point at which a piston, which is moved up and down in the cylinder bore and has piston rings and a piston skirt, reaches a speed which approaches zero during engine operation;

a region between the upper reversal point and the lower reversal point at which the piston reaches a maximum speed during engine operation;

at least two circumferential depressions formed within the region, the at least two circumferential depressions each having a diameter greater than a diameter of the cylinder bore above the region and below the region;

wherein a roughness of the cylinder running surface in a region of the at least two circumferential depressions is less than in regions outside the at least two circumferential depressions; and wherein the diameters of the at least two circumferential depressions are greater by 5 μm to 30 μm than at least one of the diameter of the cylinder bore above the region and the diameter of the cylinder bore below the region.

2. The cylinder bore as claimed in claim 1, wherein the diameters of the at least two circumferential depressions are the same.

3. The cylinder bore as claimed in claim 1, wherein the diameter of the cylinder bore above the region and below the region are the same.

4. The cylinder bore as claimed in claim 1, wherein the diameter of the cylinder bore above the region and below the region are constant over axial heights of the cylinder bore above the region and below the region.

5. The cylinder bore as claimed in claim 1, wherein a roughness of the cylinder running surface in a region of the at least two circumferential depressions is less than 3 μm.

6. The cylinder bore as claimed in claim 5, wherein the roughness of the cylinder running surface in the region of the at least two circumferential depressions is less than 1 μm.

7. The cylinder bore as claimed in claim 6, wherein the roughness of the cylinder running surface in the region of the at least two circumferential depressions is less than 0.5 μm.

8. The cylinder bore as claimed in claim 1, wherein the cylinder running surface has, at least partially in a region outside the at least two circumferential depressions, a hardness greater than in a region of the at least two circumferential depressions.

9. The cylinder bore as claimed in claim 1, wherein the at least two circumferential depressions merge into adjacent portions of the cylinder running surface via a curved transition.

10. The cylinder bore as claimed in claim 1, wherein:

an intermediate region of the cylinder running surface extends axially between the at least two circumferential depressions; and the intermediate region of the cylinder running surface includes a max speed point at which the piston reaches the maximum speed during engine operation.

11. An arrangement for a cylinder housing of an internal combustion engine, comprising:

a piston having piston rings and a piston skirt; and a cylinder bore in which the piston is moved up and down, the cylinder bore having:

a cylinder running surface;

an upper reversal point and a lower reversal point at which the piston reaches a speed which approaches zero during engine operation;

a region between the upper reversal point and the lower reversal point at which the piston reaches a maximum speed during engine operation; and at least two circumferential depressions formed within the region, the at least two circumferential depressions each having a diameter greater than a diameter of the cylinder bore above the region and below the region;

wherein at least one piston ring, at least in a contact region with the cylinder running surface, includes one of a CrN coating and a DLC coating produced by a PVD process; and wherein the cylinder running surface has, at least partially in a region outside the at least two circumferential depressions, a hardness greater than in a region of the at least two circumferential depressions.

12. The arrangement as claimed in claim 11, wherein at least the piston skirt includes a steel material.

13. The arrangement as claimed in claim 11, wherein the arrangement is configured for an internal combustion engine for motor vehicles having at least two cylinders.

14. The arrangement as claimed in claim 11, wherein the diameter of the cylinder bore above the region and below the region are constant over axial heights of the cylinder bore above the region and below the region.

15. The arrangement as claimed in claim 11, wherein the diameters of the at least two circumferential depressions are greater by 5 μm to 30 μm than at least one of the diameter of the cylinder bore above the region and the diameter of the cylinder bore below the region.

16. The arrangement as claimed in claim 11, wherein a roughness of the cylinder running surface in a region of the at least two circumferential depressions is less than in regions outside the at least two circumferential depressions.

17. The arrangement as claimed in claim 11, wherein a roughness of the cylinder running surface in a region of the at least two circumferential depressions is less than 3 μm.

18. An arrangement for a cylinder housing of an internal combustion engine, comprising a piston including a plurality of piston rings and a piston skirt, and a cylinder bore in which the piston is disposed, the cylinder bore including:

a cylindrical interior running surface having an upper reversal point and a lower reversal point between which the piston axially slides within the piston bore during engine operation; and at least two circumferential depressions disposed in a region between the upper reversal point and the lower reversal point at which the piston reaches a maximum speed during engine operation;

wherein the at least two circumferential depressions each have a diameter that is 5 μm to 30 μm greater than a diameter of the cylinder bore above the region and below the region; and wherein the running surface has a surface roughness of 3 μm Rz or less in a region of the at least two circumferential depressions.

19. The arrangement as claimed in claim 18, wherein: an intermediate region of the cylindrical running surface extends axially between the at least two circumferential depressions; the piston is disposed within the cylinder bore with play between the piston and the cylindrical running surface; and when aligned with the intermediate region of the cylindrical running surface, at least one of the plurality of piston rings is in tight sliding contact with the intermediate region of the cylindrical running surface such that the piston is substantially prevented from deflecting and striking the cylindrical running surface.

* * * * *